US007544649B2

(12) United States Patent
Aihara et al.

(10) Patent No.: US 7,544,649 B2
(45) Date of Patent: Jun. 9, 2009

(54) ANTIFOULING DETERGENT FOR HARD SURFACES

(75) Inventors: Shin Aihara, Wakayama (JP); Yosuke Komatsu, Wakayama (JP); Kazunori Tsukuda, Wakayama (JP); Seiichi Miyanaga, Wakayama (JP); Kenichi Shiba, Wakayama (JP)

(73) Assignee: Kao Corporation, Tokyo (JP)

( * ) Notice: Subject to any disclaimer, the term of this patent is extended or adjusted under 35 U.S.C. 154(b) by 320 days.

(21) Appl. No.: 10/500,859

(22) PCT Filed: Feb. 21, 2003

(86) PCT No.: PCT/JP03/01940

§ 371 (c)(1),
(2), (4) Date: Jul. 19, 2004

(87) PCT Pub. No.: WO03/070867

PCT Pub. Date: Aug. 28, 2003

(65) Prior Publication Data

US 2006/0058211 A1 Mar. 16, 2006

(30) Foreign Application Priority Data

Feb. 22, 2002 (JP) ..... 2002-046122

(51) Int. Cl.
*C11D 1/38* (2006.01)
*C11D 3/26* (2006.01)
*C11D 3/37* (2006.01)

(52) U.S. Cl. ..... 510/191; 510/433; 510/434; 510/475; 510/476; 510/504; 134/42

(58) Field of Classification Search ..... 510/191, 510/433, 434, 475, 476, 504; 134/42
See application file for complete search history.

(56) References Cited

U.S. PATENT DOCUMENTS 3,772,076 A * 11/1973 Keim ..... 162/164.3
3,920,392 A * 11/1975 Harada et al. ..... 422/7
4,652,390 A * 3/1987 Strampach et al. ..... 510/295
5,214,112 A * 5/1993 Shimizu et al. ..... 526/62
5,500,323 A * 3/1996 Baur et al. ..... 430/108.22
5,872,088 A * 2/1999 Pucci et al. ..... 510/238
6,030,738 A * 2/2000 Michel et al. ..... 430/108.22
6,251,849 B1 * 6/2001 Jeschke et al. ..... 510/470
6,593,288 B2 * 7/2003 Aubay et al. ..... 510/504
6,610,283 B1 * 8/2003 Holmes-Farley et al. . 424/78.18
6,703,358 B1 * 3/2004 Aubay et al. ..... 510/434

FOREIGN PATENT DOCUMENTS

| | | |
|---|---|---|
| EP | 342 997 | 11/1989 |
| EP | 467 472 | 1/1992 |
| JP | 51-18280 | 6/1976 |
| JP | 53-10539 | 4/1978 |
| JP | 7-102299 | 4/1995 |
| JP | 9-169995 | 6/1997 |
| JP | 2000-096049 | 4/2000 |
| JP | 2001-181353 | 7/2001 |
| JP | 2001-181601 | 7/2001 |
| JP | 2001-271094 | 10/2001 |
| WO | 02/16536 | 2/2002 |

OTHER PUBLICATIONS

U.S. Appl. No. 10/500,469, filed Jul. 15, 2004, Aihara, et al.
U.S. Appl. No. 10/500,859, filed Jul. 19, 2004, Aihara, et al.

* cited by examiner

*Primary Examiner*—Gregory R Del Cotto
(74) *Attorney, Agent, or Firm*—Oblon, Spivak, McClelland, Maier & Neustadt, P.C.

(57) ABSTRACT

This invention provides an antifouling detergent for hard surfaces, which is excellent in antifouling effect without any problem in corrosion of metallic materials. The antifouling detergent for hard surfaces comprises a polymer comprising a monomer unit A having at least one group selected from amino groups and quaternary ammonium groups and a monomer unit B represented by —$SO_2$—, in a specific ratio in the molecule.

4 Claims, No Drawings

ANTIFOULING DETERGENT FOR HARD SURFACES

TECHNICAL FIELD OF THE INVENTION

This invention relates to a detergent which has soil-preventing effect (hereinafter "an antifouling detregent) for hard surfaces, which has antifouling performance capable of preventing fouling and easily removing fouling on hard surfaces and in particular to an antifouling detergent for hard surfaces, which can be used generally in a house, particularly in a wall, floor, instruments and devices in a kitchen, a bathroom, a toilet and a washstand, especially inside a toilet bowl in order to prevent fouling and to easily remove fouling.

DESCRIPTION OF THE RELATED ART

Surfaces of various living articles can be easily stained harmfully by fouling, for example, soils, deposition, dirt and so on. To remove fouling, various detergents have been developed and examined to enhance their detergency.

However, such detergents do necessarily not achieve reduction of time and labor for removal of fouling, such as reduction of the frequency of cleaning, and there is a demand for development of a detergent having an antifouling effect.

JP-A 2001-181353, JP-A 2001-271094 and JP-A 2001-181601 disclose an antifouling detergent using amphoteric polymers compound having a molecular weight of 1000 to 1,000,000 prepared from an anionic vinyl monomer and dialkylaminoalkyl (meth)acrylate or dialkylaminoalkyl (meth)acrylamide. JP-A 9-169995 discloses a toilet bowl antifouling detergent lowering a surface tension inside a toilet bowl and exhibiting an antifouling effect by using, as antifouling base materials, an anionic surfactant with a cationic polymer compound or a cationic surfactant such as dimethyldiallylammonium chloride homopolymer having a molecular weight of 100,000 to 1,000,000, dimethyldiallylammonium chloride/acrylamide copolymer having a molecular weight of 1,000,000 to 10,000,000 or dimethyldiallylammonium chloride/acrylic acid copolymer having a molecular weight of 1,700,000.

Further, JP-A 7-102299 discloses a foaming type of toilet bowl detergent comprising dimethyldiallylammonium chloride/acrylamide copolymer having a molecular weight of 500,000, together with a mineral acid, a monoalkyl quaternary ammonium salt and a nonionic surfactant.

Further, EP-A 342997 discloses a multipurpose detergent composition comprising a nonionic surfactant, a bactericidal cationic surfactant and a non-anionic polymer capable of adsorption onto hard surfaces and as such non-anionic polymers poly(dimethyldiallylammonium chloride) (trade name: Merquat 100 (ex Merck)) and other polymers are disclosed. EP-A 467472 discloses a liquid detergent composition for hard surfaces and a cationic quaternary polymethacrylate, for example, a polymer having a beta-(trialkylammonium)alkyl methacrylate unit, with a molecular weight of 5,000 to 50,000, is mentioned.

In these techniques, an antifouling effect can be achieved to a certain degree but is still not at satisfactory levels, and upon applicating onto the surface of metal such as iron and stainless steel, there is the problem of occurrence of rust, so there is a demand for a method of solving these problems.

The present inventors previously found, in WO-A 2002/16536 published on Feb. 28, 2002, that a sterilizing detergent using both a cationic surfactant and a polymer comprising a monomer unit having quaternary ammonium groups can have an improved antifouling effect on hard surfaces without reducing its sterilizing effect. For exhibiting the antifouling effect, however, adhesion of the polymer to a hard surface is necessary but the cationic surfactant also adheres to the hard surface, so the two compounds are in a competitive state, which makes incorporation of a large amount of the polymer necessary.

On one hand, JP-B 51-18280 discloses that a polymer compound having —$SO_2$— as a monomer unit in the molecule is useful as a coating or an adhesive. Further, JP-B 53-10539 discloses that a polymer compound having —$SO_2$— as a monomer unit is useful as an anti-corrosive agent for metal. However, these publications do not suggest any antifouling effect, and a satisfactory antifouling effect cannot be achieved even using the polymer compounds described in the Examples in the publications.

SUMMARY OF THE INVENTION

Accordingly, the object of this invention is to provide an antifouling detergent for hard surfaces, which is excellent in antifouling effect without any problem in corrosion of metallic materials. Further, this invention provides an antifouling detergent for hard surfaces, which can exhibit the effect in a smaller amount by using a polymer more excellent in adsorption onto hard surfaces, and which, even when used in combination with a cationic surfactant, exhibits a satisfactory antifouling effect without exerting any influence on the cationic surfactant.

This invention provides an antifouling detergent for hard surfaces, comprising a polymer [hereinafer, referred to as component (a)] comprising, in the molecule, a monomer unit A having at least one group selected from amino groups and quaternary ammonium groups and a monomer unit B represented by —$SO_2$—, wherein the content of the monomer unit A in the whole monomer units is 10 to 99 mol-% and the molar ratio of the monomer unit B/the monomer unit A is from 0.01 to 1.

Further, this invention provides an antifouling detergent composition for hard surfaces, comprising the above-described polymers (a) and surfactants (b) such as cationic surfactants. In addition, this invention provides a method of antifouling and cleaning hard surfaces, which comprises treating hard surfaces with the above-described polymer or composition or use of the above-described polymer or composition as an antifouling detergent for hard surfaces. The hard surfaces are particularly inside surfaces of toilet bowl and those of ceramic tiles.

DETAILED DESCRIPTION OF THE INVENTION

In the component (a), the molar ratio of monomer unit B/monomer unit A is from 0.01 to 1, preferably 0.03 to 0.75, and particularly preferably 0.05 to 0.5.

The monomer used for constituting the monomer unit A is preferably at least one member selected from a compound of the general formula (1) and a compound of the general formula (2).

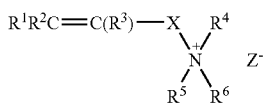

(1)

-continued

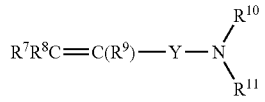

(2)

wherein $R^1$, $R^2$, $R^3$, $R^7$, $R^8$ and $R^9$ each represent a hydrogen atom, a hydroxyl group or a $C_{1-3}$ alkyl group; each of X and Y is a group selected from a $C_{1-12}$ alkylene group, —$COOR^{12}$—, —$CONHR^{12}$—, —$OCOR^{12}$— and —$R^{13}$—OCO—$R^{12}$— whereupon $R^{12}$ and $R^{13}$ each represent a $C_{1-5}$ alkylene group; $R^4$ represents a $C_{1-3}$ alkyl group, a $C_{1-3}$ hydroxyalkyl group or $R^1R^2C{=}C(R^3)$—X—; $R^5$ represents a $C_{1-3}$ alkyl group, a $C_{1-3}$ hydroxyalkyl group or a benzyl group; $R^6$ represents a $C_{1-10}$ alkyl group which may be substituted with a hydroxy group, a carboxyl group, a sulfonate group or a sulfate group or a benzyl group, provided that when $R^6$ is an alkyl group, a hydroxyalkyl group or a benzyl group, $Z^{31}$ represents an anion and when $R^6$ contains a carboxyl group, a sulfonate group and a sulfate group, $Z^-$ is absent, but these groups of $R^6$ are anions; the anion represented by Z includes, for example, a halogen ion, a sulfate ion, a $C_{1-3}$ alkyl sulfate ion, an aromatic sulfonate ion which may be substituted with a $C_{1-3}$ alkyl group, and a hydroxy ion; $R^{10}$ represents a hydrogen atom, a $C_{1-3}$ alkyl group, a $C_{1-3}$ hydroxyalkyl group or $R^7R^8C{=}C(R^9)$—Y—; and $R^{11}$ represents a hydrogen atom, a $C_{1-3}$ alkyl group or a $C_{1-3}$ hydroxyalkyl group.

Specifically, the compound of the formula (1) is preferably (ω-acryloylamino (or methacryloylamino)alkyl (C1 to C5) trialkyl (C1 to C3) ammonium salt, acryloyloxy (or methacryloyloxy) alkyl (C1 to C5) trialkyl (C1 to C3) ammonium salt, (ω-alkenyl (C2 to C10) trialkyl (C1 to C3) ammonium salt, di(ω-alkenyl (C2 to C10) dialkyl (C1to C3) ammonium salt, particularly preferably a diallyldimethylammonium salt.

Specifically, the compound of the formula (2) is preferably dialkyl (C1 to C3) aminoalkyl (C1 to C5) acrylamide (or methacryloylamide), dialkyl(C1 to C3)aminoalkyl(C1 to C5)acrylate(or methacrylate), N-(ω-alkenyl(C2 to C10))-N, N-dialkyl(C1 to C3)amine, N,N-di(ω-alkenyl(C2 to C10))-N-alkyl(C1 to C3)amine, N,N-di(ω-alkenyl(C2 to C10)) amine allylamine, diallylmethylamine or diallylamine. In particular preferable is allylamine, diallylmethylamine, diallylamine, dimethylaminopropylacrylamido(or methacrylamide) or dimethylaminoethyl acrylate (or methacrylate). The monomer unit A is contained in a ratio of 10-99 mol-% to the whole monomers. The ratio is preferably 20-99 mol-%, and more preferably 30-90 mol-%.

The monomer unit B in the polymer as component (a) is —$SO_2$—, and the polymer containing this monomer unit can be obtained by introducing a predetermined amount of $SO_2$ gas into a solution comprising the compound of the general formula (1) and/or the compound of the general formula (2), followed by polymerizing then with a intiator selected from benzoyl peroxide, t-butyl hydroperoxide, cumene hydroperoxide, lauroyl peroxide, 2,2'-azobis(isobutyronitrile), 2,2'-azobis(isovaleronitrile), 2,2'-azobis(2,4-dimethylvaleronitrile), 2,2'-azobis(2-amidinopropane)dihydrochloride, methyl ethyl ketone peroxide, cyclohexanone peroxide, peracetic acid, perbenzoic acid, persulfates, and hydrogen peroxide. In the polymerization, a solvent can be used, and specifically it is possible to use water, an alcohol compound selected from methanol, ethanol and propanol, a ketone selected from acetone and methyl ethyl ketone, and dimethyl sulfoxide, dimethyl formamide, dimethylacetamide, N-methylimidazolidinone, acetonitrile, propionitrile, toluene, xylene and hexane. The polymerization temperature is varied depending on the solvent or combination with the initiator, preferably −20 to 200° C., and preferably −10 to 100° C. Further, in this invention, the polymerization can also be initiated by photo irradiation or radiation, and in the former case, the polymerization may proceed more efficiently by irradiating lights of wavelengths of 300 to 450 nm.

By including the monomer unit B, the polymer can achieve the high adhesive ability to hard surfaces even at a low concentration as well as anti-rust property, and become ignorant to the cationic surfactant used in combination with.

For the purpose of further improving the antifouling effect, it is preferable in this invention that the component (a) comprises a monomer unit C derived from a monomer selected from the following (i) to (iv):

(i) An anionic group-containing compound selected from acrylic acid or salts thereof, methacrylic acid or salts thereof, maleic acid or salts thereof, maleic anhydride, styrene sulfonate, 2-acrylamido-2-methylpropanesulfonate, allyl sulfonate, vinyl sulfonate, methallyl sulfonate, sulfopropyl methacrylate, and mono-ω-methacryloyloxyalkyl(C1 to 12) phosphate.

(ii) An amide group-containing compound selected from acryl(or methacryl)amide, N,N-dimethylaminopropylacryl (or methacryl)amide, N,N-dimethylacryl(or methacryl) amide, N,N-dimethylaminoethylacryl (or methacryl)amide, N,N-dimethylaminomethylacryl (or methacryl)amide, N-vinyl-2-caprolactam, and N-vinyl-2-pyrrolidone.

(iii) An ester group-containing compound selected from alkyl(C1 to C5) acrylate(or methacrylate), 2-hydroxyethyl acrylate(or methacrylate), N,N-dimethylaminoalkyl(C1 to 5) acrylate(or methacrylate), and vinyl acetate.

(iv) An olefinic compound selected from ethylene, propylene, n-butylene, isobutylene, n-pentene, isoprene, 2-methyl-1-butene, n-hexene, 2-methyl-1-pentene, 3-methyl-1-pentene, 4-methyl-1-pentene, 2-ethyl-1-butene, styrene, vinyl toluene and α-methylstyrene.

Among these, a monomer unit derived from the monomer (i) or (ii) is particularly preferable from the view point of the antifouling effect, among which most preferable is a monomer unit derived from the monomer (i), and particularly acrylic acid or sodium or potassium salts thereof, methacrylic acid or sodium or potassium salts thereof, and maleic acid or sodium or potassium salts thereof are preferable. A counterion for the monomer unit derived from the monomer (i) may be a cationic-group moiety of the polymer comprising the counterion.

When the component (a) has the monomer unit C, the molar ratio of monomer unit C/monomer unit A is preferably 0.05 to 1, more preferably 0.1 to 0.75, particularly more preferably 0.2 to 0.5, from the viewpoint of the antifouling effect.

The weight-average molecular weight of the polymer of the invention is preferably 1,000 to 6,000,000, more preferably 1,000 to 500,000, still more preferably 1,000 to 100,000, particularly more preferably 5,000 to 60,000, and this weight-average molecular weight is determined by gel permeation chromatography using polyethylene glycol as standards with a mixed solvent of acetonitrile and water (phosphate buffer) as an eluent.

In the polymer used as component (a) in this invention, the monomer unit A, monomer unit B and preferably monomer unit C may be present in either the main chain or side chains in the polymer. These may be polymerized in the form of a random, block or graft polymer. In this invention, a polymer composed exclusively of the monomer units A, B and C is most preferably used.

The component (a) is contained in an amount of preferably 0.01 to 35 mass-%, more preferably 0.02 to 25 mass-%, in the antifouling detergent for hard surfaces in this invention, and when the hard surface is washed by a spraying method of using a spray device such as a trigger or an aerosol or by a applying method, the concentration of the component (a) is from 0.01 to 10 mass-%, more preferably 0.02 to 5 mass-%, still more preferably 0.05 to 2 mass-%. On the other hand, an automatic toilet bowl cleaner that can feed a suitable amount of a detergent to water in a toilet tank by arranging the device in the tank or in an arbitrary water-feeding passage is used in a method of washing with water in a toilet tank, the component (a) is comprised in an amount of 2 to 35 mass-%, more preferably 3 to 25 mass-%, still more preferably 4 to 15 mass-%. The concentration of the component (a) in the tank is preferably 0.05 to 15 ppm (ratio by mass; this applies hereinafter), more preferably 0.1 to 10 ppm.

Further, the polymer of this invention even when used in combination with a cationic surfactant is hardly influenced by the cationic surfactant, and can exhibit a satisfactory antifouling effect in a smaller amount.

The pH value of the antifouling detergent of this invention at 20° C. is preferably 2 to 12, more preferably 3 to 11, particularly preferably 5 to 8 from the view point of the antifouling detergent effect. As the pH adjusting agent, acidic agents, for example, inorganic acids such as hydrochloric acid and sulfuric acid, organic acids such as citric acid, succinic acid, malic acid, fumaric acid, tartaric acid, malonic acid and maleic acid, and alkali agents, for example, sodium hydroxide, potassium hydroxide, ammonia or derivatives thereof, amine compounds such as monoethanolamine, diethanolamine and triethanolamine, and sodium carbonate and potassium carbonate, can be used alone or as a mixture thereof. Further, these acid agents and alkali agents may be combined for use as a buffer system.

A surfactant (referred to hereinafter as component (b)) is comprised preferably in the antifouling detergent for hard surfaces in this invention for the purpose of improving the antifouling detergent effect and conferring an ability to foam in improving adhesion and a feel of the detergent effect during use. As the surfactant, at least one member selected from an anionic surfactant, a nonionic surfactant, a cationic surfactant and an amphoteric surfactant is preferable.

Preferable examples of the anionic surfactant include alkylbenzenesulfonates, alkanesulfonates, α-olefin sulfonates, alkyl sulfates, polyoxyethylene (average number of molecules added: 1 to 10) alkyl ether sulfates and polyoxyethylene (average number of molecules added: 1 to 10) alkyl ether acetates, all of which have $C_{8-18}$ alkyl groups, among which alkylbenzenesulfonates having $C_{10-15}$ alkyl groups, alkyl sulfonates having $C_{8-14}$ alkyl groups, and polyoxyethylene (average number of molecules added: 1 to 5) alkyl ether sulfates having $C_{10-14}$ alkyl groups are preferable. The salts thereof are preferably sodium or potassium salts.

As the nonionic surfactant, the compound of the formula (3) below and/or the compound of the formula (4) below are preferable in respect of the antifouling detergent effect.

$$R^{14}\text{-}T\text{-}[(R^{15}O)_a\text{—}R^{16}]_b \quad (3)$$

wherein $R^{14}$ represents a $C_{8-20}$, preferably $C_{10-18}$ alkyl group or alkenyl group; $R^{15}$ represents a $C_2$ or $C_3$ alkylene group, preferably an ethylene group; $R^{16}$ represents a $C_{1-3}$ alkyl group or a hydrogen atom; a is the number of 1 to 100 on the average, preferably 3 to 80, more preferably 5 to 40, still more preferably 5 to 20; T is —O—, —COO—, —CON— or —N—, and when T is —O— or —COO—, b is 1, and when T is —CON— or —N—, b is 1 or 2.

$$R^{17}\text{—}(OR^{18})_cG_d \quad (4)$$

wherein $R^{17}$ represents a linear $C_{8-16}$, preferably $C_{10-16}$, particularly preferably $C_{10-14}$ alkyl group; $R^{18}$ represents a $C_{2-4}$ alkylene group, preferably an ethylene group or a propylene group, particularly preferably an ethylene group; G is a residue derived from a reducing sugar; c is the number of 0 to 6 on the average; and d is the number of 1 to 10 on the average, preferably 1 to 5, particularly preferably 1 to 2.

Examples of the compound of the formula (3) include the following compounds:

$$R^{14}\text{—}O\text{—}(C_2H_4O)_e\text{—}H$$

wherein $R^{14}$ has the same meaning as defined above, and e is the number of 1 to 100 on the average, preferably 5 to 20.

$$R^{14}\text{—}O\text{—}(C_2H_4O)_f\text{—}(C_3H_6O)_g\text{—}H$$

wherein $R^{14}$ has the same meaning as defined above; f and g represent each the number of 1 to 20 on the average, preferably 1 to 10; and ethylene oxide(hereinafter EO) and propylene oxide (hereinafter PO) maybe a random or block addition product.

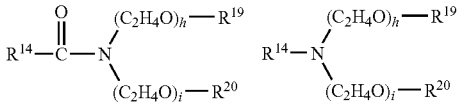

wherein $R^{14}$ has the same meaning as defined above; h and i each represent the number of 0 to 40 on the average, preferably 0 to 20; h+i is the number of 1 to 20 on the average, preferably 1 to 15; $R^{19}$ and $R^{20}$ each represent a hydrogen atom or a $C_{1-3}$ alkyl group.

In the compound of the formula (4), G is a residue derived from a reducing sugar, and the starting reducing sugar may be either aldose or ketose, and includes $C_{3-6}$ sugars such as triose, tetrose, pentose and hexose. Examples of the aldose include apiose, arabinose, galactose, glucose, lyxose, mannose, aldose, idose, talose and xylose, and the ketose includes fructose. In this invention, a $C_{5-6}$ aldopentose or an aldohexose is particularly preferable among these, and glucose is most preferable.

In respect of the antifouling detergent effect, the cationic surfactants are preferably compounds of the formulae (5) to (7):

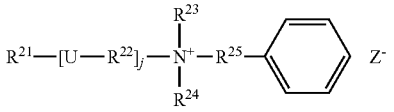

(5)

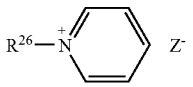

(6)

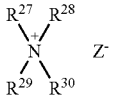

(7)

wherein $R^{21}$ represents a $C_{5-18}$, preferably $C_{6-14}$, particularly preferably $C_{8-12}$ alkyl or alkenyl group, preferably an alkyl group; $R^{23}$ and $R^{24}$ represent a $C_{1-3}$ alkyl group, or a $C_{1-3}$ hydroxyalkyl group; U represents —COO—, —OCO—, —CONH—, —NHCO—, or

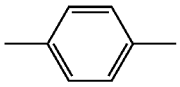

j is an integer of 0 or 1; $R^{22}$ represents a $C_{1-6}$ alkylene group or $—(O—R^{31})_k—$ whereupon $R^{31}$ represents an ethylene group or a propylene group, preferably an ethylene group, k is the number of 1 to 10 on the average, preferably 1 to 5; $R^{25}$ represents a $C_{1-5}$, preferably $C_{1-3}$, alkylene group; $R^{26}$ represents a $C_{8-16}$alkyl group; two or more (preferably two) of $R^{27}$, $R^{28}$, $R^{29}$ and $R^{30}$ represent a $C_{8-18}$, preferably $C_{8-12}$, alkyl group while the remainder represents a $C_{1-3}$ alkyl group or a $C_{1-3}$ hydroxyalkyl group; and $Z^-$ represents an anionic group, preferably a halogen ion or a $C_{1-3}$ alkyl sulfate ion.

Among the surfactants of the formulae above, the most preferable cationic surfactant in this invention includes:

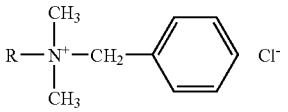

wherein R is a $C_{8-18}$, preferably $C_{8-14}$ alkyl group.

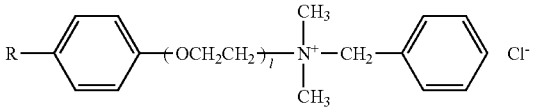

wherein R is an optionally branched $C_{6-10}$ alkyl group, and l is the number of 1 to 5 on the average.

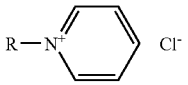

wherein R is a $C_{8-12}$ alkyl group.

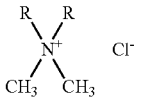

Wherein groups of R each represents a $C_{8-12}$ alkyl group.

The amphoteric surfactants are preferably compounds of the following formulae (8) and (9):

(8)

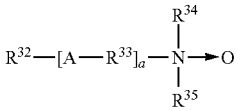

wherein $R^{32}$ represents a $C_{8-16}$, preferably $C_{10-16}$, particularly preferably $C_{10-14}$ linear alkyl or alkenyl group; $R^{34}$ and $R^{35}$ represent a $C_{1-3}$ alkyl group or a $C_{1-3}$ hydroxyalkyl group; $R^{33}$ represents a $C_{1-5}$, preferably $C_2$ or $C_3$, alkylene group; A is a group selected from —COO—, —CONH—, —OCO—, —NHCO— and —O—; and a is an integer of 0 or 1, preferably 1.

(9)

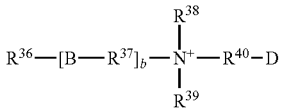

wherein $R^{36}$ represents a $C_{9-23}$, preferably $C_{9-17}$, particularly preferably $C_{10-16}$ alkyl or alkenyl group; $R^{37}$ represents a $C_{1-6}$, preferably $C_{1-4}$, particularly preferably $C_2$ or $C_3$ alkylene group; B is a group selected from —COO—, —CONH—, —OCO—, —NHCO— and —O—; b is an integer of 0 or 1, preferably 0; $R^{38}$ and $R^{39}$ each represent a $C_{1-3}$ alkyl group or a $C_{1-3}$ hydroxyalkyl group, preferably a methyl group, an ethyl group or a hydroxyethyl group; $R^{40}$ represents a $C_{1-5}$, preferably $C_{1-3}$, alkylene group which may be substituted with a hydroxy group; D is a group selected from $—COO^-$, $—SO_3^-$, and $—OSO_3^-$, among which $—OSO_3^-$ is preferable to regulate viscosity as desired or $—COO^-$ is preferable in respect of the ability to foam.

The surfactant in this invention is preferably a nonionic surfactant and/or a cationic surfactant from the view point of the antifouling effect, particularly preferably a nonionic surfactant selected from the compounds of the general formula (3) and the compounds of the general formula (4) and/or a cationic surfactant selected from the compounds of the general formula (5), most preferably a cationic surfactant selected from the compounds of the general formula (5), and particulary a cationic surfactant selected from the compound of the formula(5) is preferably incorporated as an essential ingredient.

To confer the ability to foam in improving adhesion and a feel of the detergent effect during use, the surfactant is preferably a nonionic surfactant and amphoteric surfactant, particularly preferably a nonionic surfactant selected from the compounds of the formula (3) and the compounds of the formula (4) and an amphoteric surfactant selected from the compounds of the formula (8) and the compounds of the formula (9), still more preferably a nonionic surfactant selected from the compounds of the formula (4) and an amphoteric surfactant selected from the compounds of the formula (9).

The component (b) is contained in an amount of preferably 0.001 to 50 mass-%, more preferably 0.005 to 30 mass-%, still more preferably 0.01 to 25 mass-%, in the antifouling detergent for hard surfaces in this invention, and when the hard surface of an object is cleaned by a spraying method of using a spray device such as a trigger or an aerosol or by a applying method, the concentration of the component (b) is 0.001 to 10 mass-%, more preferably 0.005 to 5 mass-%, still more preferably 0.01 to 3 mass-%, while if an automatic toilet bowl cleaner that can feed a suitable amount of a detergent to water in a toilet tank by arranging the device in the tank or in an arbitrary water-feeding passage is used in a method of washing with water in a toilet tank, the component (b) is contained in an amount of 0.1 to 50 mass-%, more preferably 1 to 30 mass-%, still more preferably 5 to 25 mass-%. The concentration of the component (b) in the toilet tank is preferably 0.01 to 20 ppm, more preferably 0.1 to 10 ppm.

Because the antifouling effect may be lowered when an anionic surfactant is used as the component (b) in this invention, it is preferable for the antifouling effect that the content of the anionic surfactant is 75 mass-% or less, preferably 50mass-% or less, particularly preferably 30 mass-% or less, relative to the total amount of the component (b) . In particular, when the cationic surfactant and anionic surfactant represented by the formulae (5) to (7) are simultaneously used, the ratio of the anionic surfactant to the cationic surfactant ratio by mass is less than 1, particularly preferably less than 0.75.

In this invention, a water-soluble solvent [hereinafter referred to as component (c)] is incorporated preferably as an arbitrary component for the purpose of improving detergency against organic soils and stability during storage, and the component (c) is preferably at least one member selected from [1] a $C_{1-5}$ monovalent alcohol, [2] a $C_{4-12}$ polyvalent alcohol, [3] a compound represented by the formula (12) below, [4] a compound represented by the formula (13) below, and [5] a compound represented by the formula (14) below.

$$R^{41}O(C_2H_4O)_m(C_3H_6O)_nR^{42} \quad (12)$$

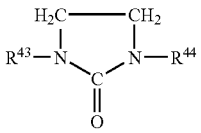

(13)

$$R^{45}OCH_2CH(OH)CH_2OH \quad (14)$$

wherein $R^{41}$ and $R^{42}$ each represent a hydrogen atom, a $C_{1-8}$ alkyl group, a phenyl group or a benzyl group, provided that $R^{41}$ and $R^{42}$ are not simultaneously hydrogen atoms; m is the number of 0 to 10 on the average, and n is the number of 0 to 10 on the average, provided that m and n are not simultaneously 0; $R^{43}$ and $R^{44}$ represent a $C_{1-3}$ alkyl group; and $R^{45}$ represents a $C_{1-8}$ alkyl group.

Generally, the $C_{2-5}$ monovalent alcohol [1] includes ethanol, propyl alcohol and isopropyl alcohol and the like. These lower alcohols can be compounded to further improve the stability of the system at low temperatures.

The $C_{4-12}$ polyvalent alcohol [2] includes isoprene glycol, 2,2,4-trimethyl-1,3-pentanediol, 1,4-butanediol, 1,5-pentanediol, 1,8-octanediol, 1,9-nonanediol, ethylene glycol, propylene glycol, diethylene glycol, dipropylene glycol and glycerin, as well as monoalkyl glyceryl ethers having $C_{3-8}$ alkyl groups and the like.

The number of carbon atoms in the compound [3] represented by the general formula (12) in case $R^{41}$ and $R^{42}$ each represent an alkyl group is particularly preferably 1 to 4. In the general formula (12), the average numbers (m and n) of EO and PO molecules added are each the number of 0 to 10 on the average, and the order of addition of EO and PO is not particularly limited, and these units may be added randomly. Examples of the compound [3] include ethylene glycol monobutyl ether, dipropylene glycol dimethyl ether, diethylene glycol monoethyl ether, diethylene glycol monobutyl ether, propylene glycol monomethyl ether, propylene glycol monopropyl ether, propylene glycol monobutyl ether, propylene glycol monoethyl ether, propylene glycol dimethyl ether, polyoxyethylene(average number of molecules added=2 to 3) polyoxypropylene(average number of molecules added=2 to 3) glycol dimethyl ether, polyoxyethylene (average number of molecules added=1 to 4) glycol phenyl ether, phenyl carbitol, phenyl cellosolve, benzyl carbitol etc. Among these, propylene glycol monomethyl ether, diethylene glycol monobutyl ether and polyoxyethylene(average number of molecules added=1 to 4) glycol phenyl ether are preferable from the view point of detergency and availability.

Preferable examples of the compound [4] include 1,3-dimethyl-2-imidazolidinone and 1,3-diethyl-2-imidazolidinone, and the compound [5] includes 3-methoxy-3-methyl butanol, 3-ethoxy-3-methyl butanol, etc.

Among those described above, a water-soluble solvent selected from the compounds [1], [2] and [3] is preferable from the view point of harmless to a base material such as plastics and rubber, and this solvent is particularly preferably a water-soluble solvent selected from ethanol, isopropyl alcohol, ethylene glycol, propylene glycol, 1,4-butanediol, 1,5-pentanediol, diethylene glycol, dipropylene glycol, glycerin, isoprene glycol, propylene glycol monomethyl ether, propylene glycol monoethyl ether, propylene glycol monopropyl ether, propylene glycol monobutyl ether, and a monoalkyl glyceryl ether having a $C_{3-8}$ alkyl group, more preferably a water-soluble solvent selected from ethanol, ethylene glycol, propylene glycol, diethylene glycol, dipropylene glycol, glycerin, 1,4-butanediol, 1,5-pentanediol, isoprene glycol, propylene glycol monomethyl ether, pentyl glyceryl ether, and octyl glyceryl ether.

The component (c) is contained in an amount of preferably 0.1 to 50 mass-%, more preferably 0.5 to 30 mass-%, in the antifouling detergent for hard surfaces in this invention, and when the hard surface of an object is cleaned by a spraying method of using a spray device such as a trigger or an aerosol or by an applying method, the concentration of the component (c) is 0.1 to 20 mass-%, more preferably 0.5 to 10 mass-%, particularly preferably 0.5 to 7 mass-%, while if an automatic toilet bowl cleaner that can feed a suitable amount of a detergent to water in a toilet tank by arranging the device in the tank or in an arbitrary water-feeding passage is used in a method of washing with water in a toilet tank, the component (c) is contained in an amount of 1 to 50 mass-%, more preferably 3 to 40 mass-%, still more preferably 5 to 30 mass-%. The concentration of the component (c) in the toilet tank is preferably 0.01 to 20 ppm, more preferably 0.1 to 10 ppm.

For the purpose of dissolving inorganic soils and improving detergency and further improving the antifouling effect in this invention, a chelating agent is incorporated preferably as component (d). The chelating agent includes (d1) tripolyphosphoric acid, pyrophosphoric acid, orthophosphoric acid, hexamethaphosphoric acid, and alkali metal salts thereof, (d2) ethylenediaminetetraacetic acid, hydroxyiminodiacetic acid, dihydroxyethyl glycine, nitrilotriacetic acid, hydroxyethylenediaminetriacetic acid, diethylenetriaminepentaacetic acid, triethylenetetraminehexaacetic acid and, alkali metal salts or alkaline earth metal salts thereof, (d3) aminotrimethylenephosphonic acid, 1-hydroxyethylidene-1,1-diphosphonic acid, ethylenediaminetetramethylenephosphonic acid, diethylenetriaminepentamethylenephosphonic acid, aminotrimethylenephosphonic acid, and alkali metal salts or alkaline earth metal salts thereof, (d4) homopolymers or copolymers of monomers selected from acrylic acid and methacrylic acid, acrylic acid-maleic acid copolymers, poly-α-hydroxyacrylic acid, and alkali metal salts thereof, (d5) one or more polyvalent carboxylic acids selected from citric acid, succinic acid, malic acid, fumaric acid, tartaric acid, malonic acid and maleic acid, and alkali metal salts thereof, (d6) alkylglycine-N,N-diacetic acid, aspartic acid-N,N-diacetic acid, serine-N,N-diacetic acid, glutamic acid diacetic acid, ethylenediaminedisuccinic acid or salts thereof, and particularly the compounds (d2), (d3) and (d5) are preferable.

The component (d) is contained in an amount of preferably 0.1 to 20 mass-% in the antifouling detergent for hard surfaces in this invention, and when the hard surface of an object is cleaned by a spraying method of using a spray device such as a trigger or an aerosol or by an applying method, the concentration of the component (d) is preferably 0.1 to 10 mass-%, more preferably 0.3 to 7 mass-%, while if an automatic toilet bowl cleaner that can feed a suitable amount of a detergent to water in a toilet tank by arranging the device in the tank or in an arbitrary water-feeding passage is used in a method of washing with water in a toilet tank, the component (d) is contained in an amount of preferably 0.1 to 20 mass-%, more preferably 0.1 to 10 mass-%. The concentration of the component (d) in the toilet tank is preferably 0.01 to 20 ppm.

For the purpose of improving storage stability and improving the ability to foam during use, a hydrotropic agent can be contained in the antifouling detergent for hard surfaces in this invention. Preferable compounds include benzenesulfonic acid whose $C_{1-3}$alkyl group is substituted with 1 to 3 groups, and salts thereof. More preferable examples of the hydrotropic agent include p-toluenesulfonic acid, m-xylenesulfonic acid, p-cumenesulfonic acid and ethylbenzenesulfonic acid, and when salts thereof are used, sodium salts, potassium salts and magnesium salts are preferable. The content of these compounds in the antifouling detergent for hard surfaces in this invention is preferably 0.1 to 10 mass-%, more preferably 0.1 to 5 mass-%, particularly preferably 0.1 to 3 mass-%.

For the purpose of improving usability by conferring adhesion during use, one or more water-soluble polymers can be added in this invention. The water-soluble polymers are not particularly limited, but one or more water-soluble polymers selected from those described on page 6, column 10, to page 7, column 11 in JP-A 8-209194 are preferable.

Beside the components described above, additives incorporated into usual detergents, for example, perfumes, antimicrobial agents, viscosity regulating agents, pigments, dyes and suspending agents can be added to the antifouling detergent for hard surfaces in this invention in such a range that the effect of this invention is not deteriorated.

When the detergent of the invention is used, the polymer as the component (a) in the form of one agent or arbitrarily divided agents combined with an arbitrary component may be dissolved or dispersed in a solvent. By combining it with an arbitrary component, the detergent of the invention can be used in the form of one or more agents as powders or tablets dissolved immediately in a solvent such as water or endowed with sustained releasability. Further, the detergent of the invention can be used in such a form that one of the component (a) and the arbitrary component is liquid, and the other is solid such as powder.

The antifouling detergent for hard surfaces in this invention is preferably a liquid antifouling detergent comprising the component (a) and an arbitrary component, the balance being water, and when used as an automatic toilet bowl cleaner, the detergent may be solidified or gelled by using a coagulating agent such as polyethylene glycol, polyethylene glycol fatty ester, polyethylene glycol fatty diester, a fatty acid or a salt. The content of water in the liquid antifouling detergent or the gelled antifouling detergent is preferably 10 to 99.99 mass-%, more preferably 20 to 98 mass-%. The content of water in the solid antifouling detergent is preferably 30 mass-% or less, more preferably 20 mass-% or less.

When the antifouling detergent for hard surfaces in this invention is used, its form is not particularly limited, but it is preferable to use <1> a method of spraying an object directly with the antifouling detergent by a sprayer such as a trigger or an aerosol, <2> a method of rubbing an object with a water-absorbing flexible material impregnated with the antifouling detergent, and <3> a method of dipping an object in a solution having the antifouling detergent dissolved therein.

In the method <1>, a trigger spray is preferable, and particularly a pressure-accumulating trigger free of sags and excellent in spray uniformity, as shown in FIG. 1 in Japanese Utility Model Application Laid-Open (JP-U) No. 4-37554, is preferably used, and the antifouling detergent is sprayed in a ratio of preferably 0.2-10 g to 100-800 $cm^2$ surface of an object. For spraying, the viscosity of the solution is 1-200 mPa·s, preferably 2-100 mPa·s.

In the method <2>, a cloth, a nonwoven fabric or a sponge can be used as the water-absorbing flexible material, and particularly a sponge is used in respect of the effect on removal of fouling.

In the method <3>, it is preferred that an object is dipped in a solution prepared by diluting the conc. liquid antifouling detergent or dissolving the solid antifouling detergent. In this dipping, an object is dipped completely in the solution optionally under suitable stirring. The dipping time is 0.5 to 300 minutes, preferably 2 to 150 minutes.

The detergent of this invention is used most preferably as a detergent for use in a toilet bowl, the detergent including detergents of automatic toilet bowl cleaner type and of spray or applying type. Preferable examples are as follows:

The polymer used as the antifouling detergent for hard surfaces in this invention is a copolymer with a weight-average molecular weight of 5,000 to 60,000, comprising the monomer unit A of the general formula (1), the monomer unit B. and at least one monomer unit C selected from the above-described (i) and (ii), wherein the molar ratio of monomer unit B/monomer unit A is from 0.05 to 0.5, and the molar ratio of monomer unit C/monomer unit A is from 0.2 to 0.5.

<Automatic Toilet Bowl Cleaner> which is preferably in a gel or liquid form, comprising:

(A) the polymer described above, 4 to 15% by mass, (B) a surfactant (provided that the cationic surfactant of the general formula (5) is blended as a major component, and the amount of an anionic surfactant blended is not higher than 30% by mass of the whole surfactant), 2 to 25% by mass, (C) a water-soluble solvent (the compound of the general formula (12), the compound of the general formula (14), ethanol, ethylene glycol, glycerin, propylene glycol, etc.), 5 to 30% by mass, (D) a chelating agent (citric acid, ethylene diamine tetraacetic acid (hereinafter EDTA), etc.), 0.1 to 10% by mass, (E) water, which is the balance, (F) arbitrary components (hydrotropic agent, coagulating agent, and other additives).

<Toilet Spray or Applying Detergent> which is preferably a liquid detergent, comprising:

(A') the polymer described above, 0.05 to 2% by mass, (B') a surfactant (provided that the cationic surfactant of the general formula (5) is blended as an essential component, and the amount of an anionic surfactant blended is not higher than 30% by mass of the whole surfactant), 0.01 to 3% by mass, (C') a water-soluble solvent (the compound of the general formula (12), the compound of the general formula (14), ethanol, ethylene glycol, glycerin, propylene glycol, etc.), 0.5 to 30% by mass, (D') a chelating agent (citric acid, EDTA, etc.), 0.1 to 10% by mass, (E') water, which is the balance, (F') arbitrary components (hydrotropic agent, coagulating agent, and other additives).

EXAMPLES

Example 1

Evaluation of Rust Prevention 50 ml solution of 20 mass-% polymer A (diallyldimethyl ammonium chloride: maleic acid: $SO_2$=50:25:25 (molar ratio), weight-average molecular weight 30,000) was placed in a specification bottle PS-NO. 11 K, and half of an iron specimen (50 mm in length×25 mm in width×3 mm in thickness) was dipped therein, and the bottle was capped and left at 40° C. for 1 month. Thereafter, when the state of the iron surface was determined with naked eyes, no rust was observed.

Comparative Example 1

Evaluation was carried out in the same manner as in Example 1 except that polymer D [diallyldimethylammonium chloride: acrylic acid=64:36 (molar ratio), weight-average molecular weight 1,700,000, Merquat 280 (Calgon)] was used, and as a result, corrosion was observed on the iron surface.

Example 2

Antifouling detergents for hard surfaces having the compositions shown in Table 1 were prepared, and their antifouling properties were evaluated in the following method. The results are shown in Table 1.

<Evaluation of Antifouling Properties>

(1) Easiness of Cleaning 1 ml of antifouling detergent was applied onto the surface of a ceramic tile having an area of 10 $cm^2$ and left for 5 minutes. Then, 200 ml water was run thereon at an angle of 45° at a flow rate of 25 mL/sec. and dried; this procedure was repeated 5 times, and 0.5 g of model stain (mixture of oleic acid and rapeseed oil in the mass ratio of 1:1) was applied on the surface of the ceramic tile. The ceramic tile onto which the model stain (mixture of oleic acid and rapeseed oil in the mass ratio of 1:1) had been applied was left at the bottom of a water tank such that the model stain (mixture of oleic acid and rapeseed oil in the mass ratio of 1:1) was not washed away, and then the water tank was filled slowly with water such that the ceramic tile was not directly splashed with water, during which the proportion of an area where the model stain (mixture of oleic acid and rapeseed oil in the mass ratio of 1:1) was removed from the surface of the ceramic tile was judged and evaluated in the following 5 stages. The percent of removal of the stain was the average percent for 10 model stained tiles.

5: Removal of 80% or more of the stain.

4: Removal of 60% to less than 80% of the stain.

3: Removal of 40% to less than 60% of the stain.

2: Removal of 20% to less than 40% of the stain.

1: Removal of less than 20% of the stain.

(2) Prevention of Adhesion of Fouling

Using a commercial toilet bowl (C730B, manufactured by Toto Ltd.), difficulty in fouling was evaluated. That is, the toilet bowl was washed with the antifouling detergent, left for 1 week, and evaluated with naked eyes for difficulty in fouling on the basis of the following criteria.

(Evaluation Criteria)

◎: No fouling.

○: Slight fouling.

Δ: Little fouling.

×: Considerable fouling.

TABLE 1

| | | Present invention products | | | | | | | | | | Comparative product | | |
|---|---|---|---|---|---|---|---|---|---|---|---|---|---|---|
| | | 2-1 | 2-2 | 2-3 | 2-4 | 2-5 | 2-6 | 2-7 | 2-8 | 2-9 | 2-10 | 2-1 | 2-2 | 2-3 |
| Compounded component (mass %) | Polymer A | 0.5 | — | — | — | 0.05 | 0.2 | 1.0 | — | — | — | — | — | — |
| | Polymer B | — | 0.5 | 0.5 | 0.5 | — | — | — | — | 0.5 | — | — | — | — |
| | Polymer C | — | — | — | — | — | — | — | 0.5 | — | 0.5 | — | — | — |
| | Polymer D | — | — | — | — | — | — | — | — | — | — | — | 0.5 | — |
| | Polymer E | — | — | — | — | — | — | — | — | — | — | — | — | 0.5 |
| | Surfactant A | — | 0.02 | — | — | — | — | — | — | — | — | — | — | — |
| | Surfactant B | — | — | 0.02 | — | — | — | — | — | — | — | — | — | — |
| | Surfactant C | — | — | — | 0.02 | 0.1 | 0.1 | 0.1 | — | — | — | — | — | — |
| | Surfactant D | — | — | — | — | — | — | — | 0.5 | — | — | — | — | — |
| | Surfactant E | — | — | — | 3.0 | — | — | — | 0.5 | — | 2.0 | — | — | — |
| | Surfactant F | — | — | — | — | — | — | — | — | 5.0 | — | — | — | — |
| | Surfactant G | — | — | 3.0 | — | — | — | — | 3.0 | — | 3.0 | — | — | — |
| | Ethanol | — | 5.0 | 5.0 | 5.0 | 5.0 | 5.0 | 5.0 | 5.0 | 5.0 | 5.0 | — | — | — |
| | EDTA-4Na | — | — | — | — | — | — | — | 5.0 | — | 2.0 | — | — | — |
| | Citric acid | — | — | — | — | — | — | — | — | 5.0 | 3.0 | — | — | — |
| | Water | balance | balance | balance | balance | balance | balance | balance | balance | balance | balance | balance | balance | balance |
| | Total | 100 | 100 | 100 | 100 | 100 | 100 | 100 | 100 | 100 | 100 | 100 | 100 | 100 |
| pH (20° C.) | | 6 | 8 | 8 | 8 | 7 | 7 | 7 | 6 | 5 | 6 | 7 | 7 | 7 |
| Easiness of detergency | | 4.4 | 4.2 | 4.0 | 4.4 | 4.0 | 4.6 | 4.8 | 4.8 | 4.4 | 4.6 | 1.0 | 3.6 | 3.2 |
| Prevention of adhension of fouling | | ○ | ○ | ○ | ◎ | ○ | ◎ | ◎ | ◎ | ○ | ○ | X | ○ | Δ |

The compounding ingredients in Table 1 are as follows:

Polymer A: diallyldimethylammonium chloride/maleic acid/$SO_2$ (molar ratio 50/25/25) copolymer, a weight-average molecular weight of 30,000. The same polymer as in Example 1 above.

Polymer B: diallyldimethylammonium chloride/$SO_2$ (molar ratio 50/50) copolymer, a weight-average molecular weight of 30,000

Polymer C: diallyldimethylammonium chloride/maleic acid/$SO_2$ (molar ratio 70/25/5) copolymer, a weight-average molecular weight of 20,000

Polymer D: Merquat 280 manufactured by Calgon, that is, diallyldimethylammonium chloride/acrylic acid (molar ratio 64/36) copolymer, a weight-average molecular weight of 1,700,000. The same polymer as in the Comparative Example 1 above.

Polymer E: Merquat 100 manufactured by Calgon, that is, diallyldimethylammonium chloride polymer, a weight-average molecular weight of 500,000

Surfactant A: Benzethonium chloride

Surfactant B: Didecyldimethylammonium chloride

Surfactant C: Cocoalkyldimethylbenzylammonium chloride

Surfactant D: Octyldimethylbenzylammonium chloride

Surfactant E: Alkyl glycoside (whose linear alkyl group contains 12 or 14 carbon atoms, average degree of condensation of the sugar(glucose)=1.2 [degree of condensation of the sugar(glucose)=1 or 2].

Surfactant F: Dodecyldimethylamine oxide

Surfactant G: N-Lauroylaminopropyl-N,N-dimethyl-N-carboxymethyl ammonium betaine EDTA-4Na: Tetrasodium ethylenediaminetetraacetate pH adjusting agent: Hydrochloric acid and/or sodium hydroxide (each of which is used in the form of an aqueous solution).

Example 3

A concentrate containing the components shown in Table 2 such that a solution with the composition shown in Table 2 could be flushed was introduced into a toilet tank, and the toilet bowl was used usually in a home where a western-style toilet was used. The fouled state after 1 week was evaluated with naked eyes under criteria below. The results are shown in Table 2. The compounding ingredients in Table 2 are the same as in Table 1.

(Evaluation Criteria)

◎: No fouling.

○: Slight fouling.

Δ: Little fouling.

×: Considerable fouling.

TABLE 2

| | | Present invention products | | | | | | | | Comparative product | |
|---|---|---|---|---|---|---|---|---|---|---|---|
| | | 3-1 | 3-2 | 3-3 | 3-4 | 3-5 | 3-6 | 3-7 | 3-8 | 3-1 | 3-2 |
| Concentration in flushed solution (ppm) | Polymer A | 1.0 | 1.0 | 1.0 | — | — | — | — | — | — | — |
| | Polymer B | — | — | — | 0.2 | 1.0 | — | — | — | — | — |
| | Polymer C | — | — | — | — | — | 0.5 | 1.0 | 5.0 | — | — |
| | Polymer D | — | — | — | — | — | — | — | — | — | — |
| | Polymer E | — | — | — | — | — | — | — | — | — | 1.0 |
| | Surfactant A | — | 1.0 | — | — | — | — | — | — | — | — |
| | Surfactant B | — | — | — | — | 1.0 | — | — | — | — | — |
| | Surfactant C | — | — | 1.0 | 0.5 | — | 0.5 | 1.0 | 3.0 | — | — |

TABLE 2-continued

| | Present invention products | | | | | | | | Comparative product | |
|---|---|---|---|---|---|---|---|---|---|---|
| | 3-1 | 3-2 | 3-3 | 3-4 | 3-5 | 3-6 | 3-7 | 3-8 | 3-1 | 3-2 |
| Surfactant E | — | — | 5.0 | — | — | — | 5.0 | 10 | — | — |
| Ethylene-glycol | 3.0 | 3.0 | 3.0 | 3.0 | 3.0 | 3.0 | 3.0 | 3.0 | 3.0 | 3.0 |
| State of fouling | ○ | ◎ | ◎ | ○ | ○ | ◎ | ◎ | ◎ | X | Δ |

Example 4

Antifouling detergent compositions for hard surfaces (present products 4-1 and 4-2 and comparative products 4-1 and 4-2) having the formulations shown in Table 3, assuming use thereof as applying liquid detergents, were prepared. Each composition was measured for its "easiness of cleaning (difficulty in fouling)" in the same manner as in Example 2. The results are also shown in Table 3.

TABLE 3

| | | Present invention products | | Comparative products | |
|---|---|---|---|---|---|
| | | 4-1 | 4-2 | 4-1 | 4-2 |
| Compounded component (mass %) | Polymer 1 | 0.2 | 0.2 | — | — |
| | Polymer 2 | — | — | 0.2 | 0.2 |
| | Cationic surfactant | 0.2 | 0.8 | 0.2 | 0.8 |
| | Water | balance | balance | balance | balance |
| Total (mass %) | | 100 | 100 | 100 | 100 |
| Easiness of detergency | | 4.6 | 4.2 | 4.2 | 2.6 |

The compositions in the table were adjusted to pH 5 (at 20° C.) with hydrochloric acid or sodium hydroxide. The materials in the table are as follows:

Polymer 1: diallyldimethylammonium chloride/maleic acid/$SO_2$ (molar ratio 50/45/5) copolymer, a weight-average molecular weight of 20,000.

Polymer 2: diallyldimethylammonium chloride/maleic acid (molar ratio 50/50) copolymer, a weight-average molecular weight of 20,000.

Cationic surfactant: Cocoalkyldimethylbenzylammonium chloride.

Example 5

Aqueous compositions (present products 5-1 and 5-2 and comparative products 5-1 and 5-2) at the concentrations shown in Table 4, assuming use thereof as automatic toilet bowl cleaners, were prepared. Each composition was measured for its "easiness of cleaning (difficulty in fouling)" in the measurement method described below. The respective components are the same as in Example 4.

<Measurement of Easiness of Cleaning (Antifouling Properties)>

100 ml of aqueous composition was prepared in a beaker, and a slide glass having an area of 10 $cm^2$ was dipped therein for 20 seconds and then dried completely by leaving the slide glass at room temperature for 15 minutes. This procedure was conducted repeatedly 10 times. 0.5 g of model stain (mixture of oleic acid and rapeseed oil in the mass ratio of 1:1) was applied, in a spot form, on the surface of the slide glass thus treated. The slide glass onto which the model stain had been applied was placed at the bottom of a water tank slowly such that the model stain was not washed away, and then the water tank was filled slowly with the aqueous composition such that the slide glass was not directly splashed with the solution, during which the proportion of an area where the model stain was removed from the surface of the slide glass was determined and evaluated in the following 5 stages. The percent of removal of the stain was the average of 5 measurements.

(Evaluation Criteria)

5: Removal of 80% or more of the stain.

4: Removal of 60% to less than 80% of the stain.

3: Removal of 40% to less than 60% of the stain.

2: Removal of 20% to less than 40% of the stain.

1: Removal of less than 20% of the stain.

TABLE 4

| | | Present invention products | | Comparative products | |
|---|---|---|---|---|---|
| | | 5-1 | 5-2 | 5-1 | 5-2 |
| Compounded component (ppm) | Polymer 1 | 1.0 | 1.0 | — | — |
| | Polymer 2 | — | — | 1.0 | 1.0 |
| | Cationic surfactant | 1.0 | 4.0 | 1.0 | 4.0 |
| | Water | balance | balance | balance | balance |
| Total (mass %) | | 100 | 100 | 100 | 100 |
| Easiness of detergency | | 4.8 | 4.0 | 4.4 | 1.0 |

For each of the aqueous compositions in the table, its 1000-conc. concentrate (antifouling detergent for hard surfaces) was prepared and adjusted by dilution with water to the concentration in Table 4. The pH value was unadjusted but identical with the pH value of water (pH 5.8 at 20° C.).

From the results in Examples 1 to 5, it is evident that the antifouling detergents for hard surfaces according to this invention are excellent in rust prevention, easiness of cleaning, and prevention of fouling, and particularly in Examples 4 and 5, the antifouling detergent exhibits particular easiness of cleaning by using it in combination with a cationic surfactant.

The invention claimed is:

1. A method of treating a hard surface comprising treating a hard surface with an antifouling detergent composition comprising an antifouling detergent and a cationic surfactant, wherein said antifouling detergent comprises a polymer which comprises a monomer unit A derived from a compound represented by the general formula (1) and/or a compound represented by the general formula (2):

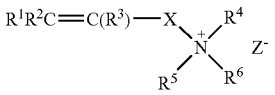

(1)

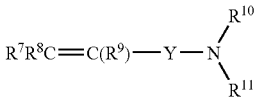

(2)

wherein $R^1$, $R^2$, $R^3$, $R^7$, $R^8$ and $R^9$ each represent a hydrogen atom, a hydroxyl group or a $C_{1-3}$ alkyl group;

X and Y are independently selected from the group consisting of a $C_{1-12}$ alkylene group, —$COOR^{12}$—, —$CONHR^{12}$—, —$OCOR^{12}$— and $R^{13}$—OCO—$R^{12}$ wherein $R^{12}$ and $R^{13}$ each represent a $C_{1-5}$ alkylene group;

$R^4$ represents a $C_{1-3}$ alkyl group, a $C_{1-3}$ hydroxyalkyl group or $R^1R^2C{=}C(R^3)$—X—;

$R^5$ represents a $C_{1-3}$ alkyl group, a $C_{1-3}$ hydroxyalkyl group or a benzyl group;

$R^6$ represents a $C_{1-10}$ alkyl group optionally substituted with a hydroxy group, a carboxyl group, a sulfonate group, a sulfate group or a benzyl group, wherein when $R^6$ comprises an alkyl group, a hydroxyalkyl group or a benzyl group, $Z^-$ represents an anion and when $R^6$ comprises a carboxyl group, a sulfonate group and a sulfate group, $Z^-$ is absent, but $R^6$ anions;

$R^{10}$ represents a hydrogen atom, a $C_{1-3}$ alkyl group, a $C_{1-3}$ hydroxyalkyl group or $R^7R^8C{=}C(R^9)$—Y—; and $R^{11}$ represents a hydrogen atom, a $C_{1-3}$ alkyl or a $C_{1-3}$ hydroxyalkyl group and a monomer unit B represented by —$SO_2$—, and a monomer unit C derived from at least one monomer selected from the group consisting of acrylic acid or salts thereof, methacrylic acid or salts thereof, maleic acid or salts thereof, maleic anhydride, styrene sulfonate, 2-acrylamido-2-methylpropanesulfonate, allyl sulfonate, vinyl sulfonate, methallyl sulfonate, sulfopropyl methacrylate, and mono-ω-methacryloyloxyalkyl(C1 to 12) phosphate wherein the content of the monomer unit A in the whole monomer units is 30 to 90 mol-% wherein the molar ratio of the monomer unit B to the monomer unit A is from 0.01 to 1, the molar ratio of the monomer unit C to the monomer unit A is from 0.05 to 1 and wherein the surface comprises the ceramic surface of a toilet bowl.

2. The method of claim 1, wherein a concentration of said polymer is 0.01 to 35 mass percent.

3. The method of claim 1, wherein said antifouling detergent composition is a liquid.

4. The method of claim 1, wherein monomer (C) further comprises at least one monomer selected from the group consisting of (ii) an amide group-containing compound selected from acryl(or methacryl)amide, N,N-dimethylaminopropylacryl(or methacryl)amide, N,N-dimethylacryl(or methacryl)amide, N,N-dimethylaminoethylacryl(or methacryl)amide, N,N-dimethylaminomethylacryl(or methacryl)amide, N-vinyl-2-caprolactam, and N-vinyl-2-pyrrolidone, (iii) an ester group-containing compound selected from alkyl(C1 to C5) acrylate(or methacrylate), 2-hydroxyethyl acrylate(or methacrylate), N,N-dimethylaminoalkyl(C1 to 5) acrylate(or methacrylate), and vinyl acetate, and (iv) an olefinic compound selected from ethylene, propylene, n-butylene, isobutylene, n-pentene, isoprene, 2-methyl-1-butene, n-hexene, 2-methyl-1-pentene, 3-methyl-1-pentene, 4-methyl-1-pentene, 2-ethyl-1-butene, styrene, vinyl toluene and α-methylstyrene.

* * * * *